US007748232B2

(12) United States Patent
Kang

(10) Patent No.: US 7,748,232 B2
(45) Date of Patent: Jul. 6, 2010

(54) FOOD CONTAINER AND REFRIGERATOR HAVING THE SAME

(75) Inventor: Dae Kil Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1069 days.

(21) Appl. No.: 11/290,453

(22) Filed: Dec. 1, 2005

(65) Prior Publication Data

US 2006/0112721 A1 Jun. 1, 2006

(30) Foreign Application Priority Data

Dec. 1, 2004 (KR) ..... 10-2004-0099684

(51) Int. Cl.
*F25D 3/08* (2006.01)

(52) U.S. Cl. ..... 62/371; 62/457.7; 62/440

(58) Field of Classification Search ..... 62/371, 62/440, 457.1, 457.3, 457.7; 220/326, 378; 312/401

See application file for complete search history.

(56) References Cited

U.S. PATENT DOCUMENTS

| | | | | | |
|---|---|---|---|---|---|
| 3,308,636 | A * | 3/1967 | Schaaf | 62/400 |
| 5,035,122 | A * | 7/1991 | Oogjen | 62/457.2 |
| 5,065,885 | A * | 11/1991 | Scaroni | 220/326 |
| 5,971,218 | A * | 10/1999 | Le | 222/185.1 |
| 6,119,679 | A * | 9/2000 | Galvin | 126/41 R |
| 2005/0006390 | A1 * | 1/2005 | Wang | 220/326 |
| 2005/0035125 | A1 * | 2/2005 | Bae | 220/326 |

* cited by examiner

*Primary Examiner*—Melvin Jones
(74) *Attorney, Agent, or Firm*—KED & Associates LLP

(57) ABSTRACT

A food container and refrigerator having the same are provided, by which contents accommodated in the food container may be taken out of the food container. The food container includes a main body having an entrance on a top side of the main body, a cover opening or closing the entrance of the main body, and a locking unit having one side connected to the main body and the other side detachably engaged with an upper part of the cover to prevent the cover from being opened.

21 Claims, 6 Drawing Sheets

FOOD CONTAINER AND REFRIGERATOR HAVING THE SAME

This application claims the benefit of the Korean Patent Application No. P2004-99684, filed on Dec. 1, 2004, which is hereby incorporated by reference as if fully set forth herein.

BACKGROUND OF THE INVENTION

1. Field of the Invention

The present invention relates to a food container, and more particularly, to a food container and refrigerator having the same.

2. Discussion of the Related Art

Generally, a refrigerator is an appliance for keeping freshness of food for a long term regardless of seasons.

For this, a general refrigerator is provided with a compressor, a condenser, an evaporator and an expander to configure a cooling cycle.

In particular, a refrigerant sequentially goes through compressor→compressor→condenser→expander→evaporator for phase changes. And, an inside of the refrigerator can be maintained at low temperature by the phase changes of the refrigerant.

The refrigerator includes a cabinet forming its exterior. And, the compressor, compressor, condenser, expander and evaporator are provided to the cabinet.

Moreover, at least one storeroom is provided within the cabinet to reserve food. The evaporator enables the inside of the cabinet, and more particularly, an inside of the storeroom to stay at low temperature so that the food stored in the storeroom can be kept fresh for a considerably long term.

Meanwhile, a food container for accommodating food therein is provided within the at least one storeroom.

The food container can be put in or pulled out of the storeroom and includes a main body having an entrance at its topside and a cover opening/closing the entrance of the main body.

To keep the freshness of food for a long term, the food container needs to secure airtightness.

Besides, the food container is applicable to other food reserving devices as well as the refrigerator.

As mentioned in the foregoing description, the food container is generally accommodated in a separate food reserving device such as a refrigerator and the like to be drawn rather than independently used.

However, in the related art, to take the food out of the food container entirely or in part, a user pulls out the food container from the storeroom of the refrigerator, places the food container on a table or floor of a room, opens the cover and then draws the food. Hence, it is inconvenient for the user to draw the food from the food container.

Meanwhile, if food is excessively accommodated in the food container, a user may be frequently troubled with pulling the food container externally.

In such a case, the user needs to draw the food from the food container remaining within the storeroom by opening the cover of the food container only without pulling the food container out of the refrigerator.

Hence, by considering that the food container is provided to the separate food reserving device such as a refrigerator to be extractable in use, the demand for developing a food container facilitating food to be taken out of the food container is rising.

SUMMARY OF THE INVENTION

Accordingly, the present invention is directed to a food container and refrigerator having the same that substantially obviate one or more problems due to limitations and disadvantages of the related art.

An object of the present invention is to provide a food container and refrigerator having the same, by which a content accommodated in the food container is facilitated to be taken out of food container.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a food container according to the present invention includes a main body having an entrance on a topside of the main body, a cover opening or closing the entrance of the main body, and a locking unit having one side connected to the main body and the other side detachably engaged with an upper part of the cover to prevent the cover from being opened.

Preferably, the cover includes an engaging member provided to a topside of the cover to be detachably engaged with the locking unit.

More preferably, the engaging member is upwardly projected from the topside of the cover in one body and a catching protrusion is provided to a lateral side of the engaging member to catch the locking unit.

Preferably, the food container further includes an unlocking part manipulated over the cover to separate the locking unit from the cover.

More preferably, the unlocking part is formed by bending the other side of the locking unit upwardly to generate a gap between a topside of the cover and the unlocking part while the locking unit is engaged with the upper part of the cover.

Preferably, the cover includes an engaging member upwardly protruding from a topside of the cover and the locking unit comprises an engaging hole into which the engaging member is inserted.

More preferably, the food container further includes a pressing member downwardly protruding from the locking unit to press the topside of the cover while the locking unit is engaged with the engaging member.

Preferably, the locking unit is rotatably connected to an upper end of the main body.

Preferably, the locking unit returns to a position having an angle of at least 90° against the cover by elasticity of the locking unit itself after having been separated from the cover.

Preferably, the food container further comprises at least one packing member between the main body and the cover for securing the airtightness of the food.

Preferably, the food container further comprises at least one handle provided to at least one of the cover and the main body.

More preferably, the at least one handle comprises at least one cover handle rotatably connected to the topside of the cover, and the cover further includes at least one handle accommodating recess provided to the topside of the cover to accommodate the at least one cover handle therein.

In another aspect of the present invention, a refrigerator includes a cabinet having at least one storeroom for keeping food and a food container accommodated in the storeroom to be vertically put/pulled in/from the storeroom, the food container including a main body having an entrance on a topside of the main body, a cover opening or closing the entrance of the main body, and a locking unit having one side connected to the main body and the other side detachably engaged with an upper part of the cover to prevent the cover from being opened.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

First of all, a food container according to one embodiment of the present invention is explained with reference to FIG. 1 and FIG. 2 as follows.

Figure 1:
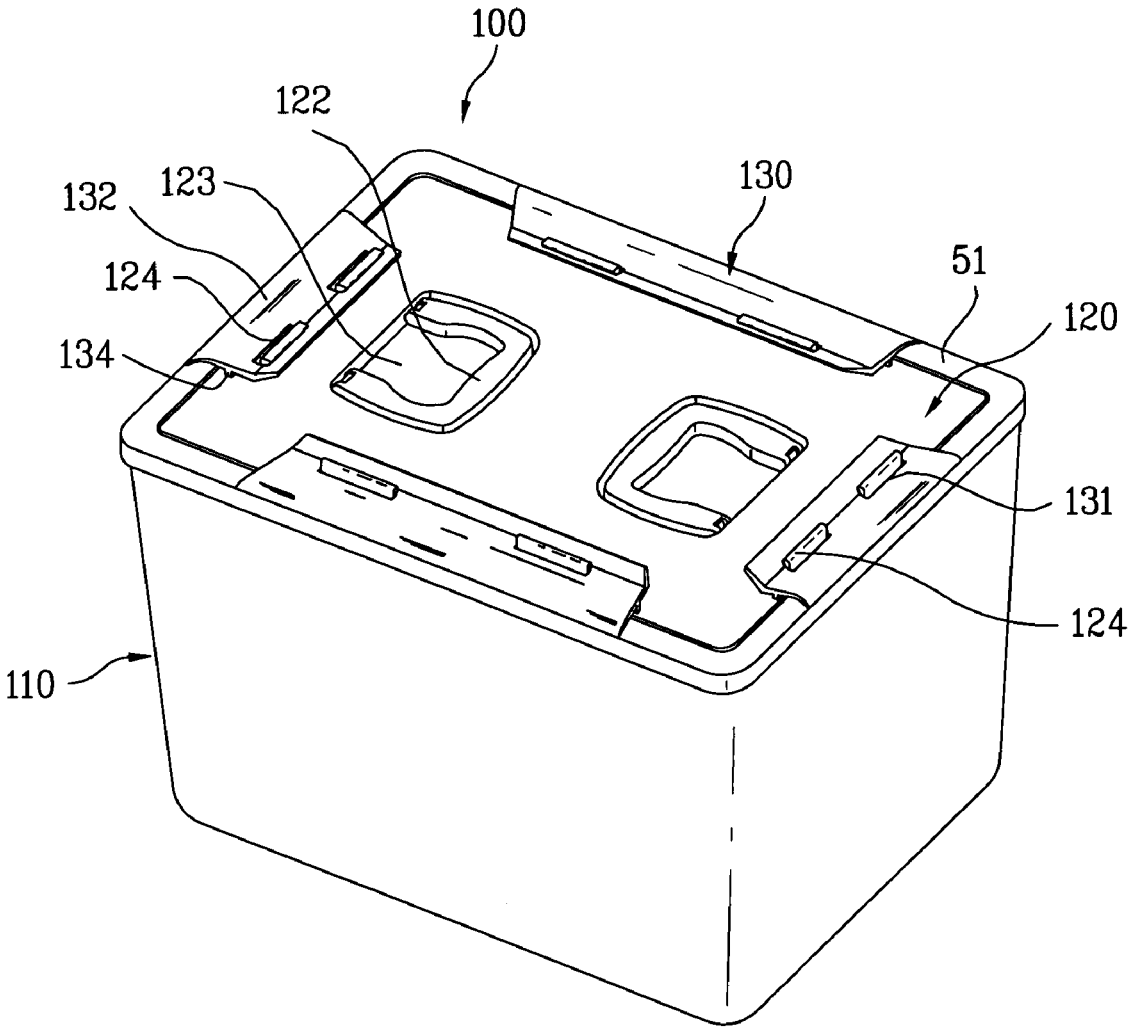
FIG. 1 is a perspective diagram of a food container according to one embodiment of the present invention.
Figure 2:
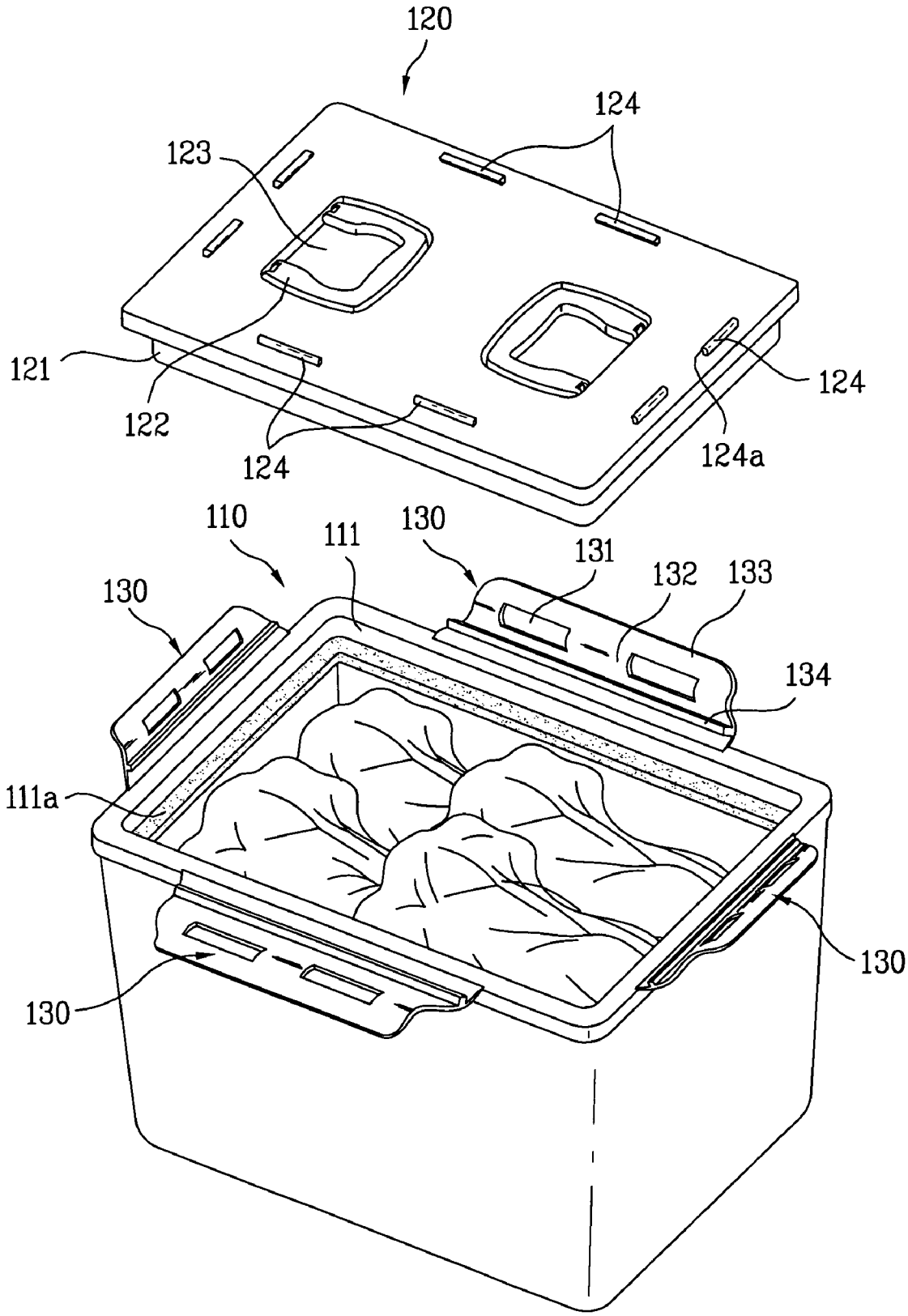
FIG. 2 is an exploded perspective diagram of the food container shown in FIG. 1, in which a main body and a cover are separated from each other.

FIG. 1 is a perspective diagram of a food container according to one embodiment of the present invention and FIG. 2 is an exploded perspective diagram of the food container shown in FIG. 1, in which a main body and a cover are separated from each other.

Referring to FIG. 1 and FIG. 2, a food container 100 according to the present invention includes a main body 110 accommodating food and a cover 120 opening/closing the main body 110.

The food container 100 preferably has an overall box type exterior for efficient space utilization of a storeroom or the like in keeping the food container 100 in a prescribed space such as the storeroom of a refrigerator and the like. Alternatively, a bottom of the food container 100 can have such a shape as a circle, an oval, a polygon and the like.

So, the food container 100 according to one embodiment of the present invention is explained with reference to a rectangular box shape of the food container 100.

An entrance is provided to a topside of the main body 110. And, a food accommodating space is provided within the main body 110 to keep the food that is put inside via the entrance.

To keep freshness of the food kept within the food container 100 for a long term, the cover 120 is fixed by a locking unit or device 130, which will be explained later, to make the main body 110 airtight.

The cover 120 is rotatably connected to one side of a rim of the entrance of the main body 110 to open/close the entrance of the main body 110. Alternatively, like in the embodiment of the present invention, the cover 120 is totally separated from the main body 110 to open the entrance of the main body 110 to facilitate the food to be put in or pulled out of the food container 100.

In this case, the cover 120 is loaded on an entrance rim of the main body 110. And, the cover 120 has a rectangular shape corresponding to a shape of the entrance of the main body 110.

In particular, the cover 120 is fitted in the entrance to a prescribed depth to shield the entrance of the main body 110.

For this, a step portion 111 is formed on an inner rim of the entrance to have the cover 120 loaded thereon. Hence, an outer circumference of the cover 120 is enclosed by a lateral side of the step portion 111 and a bottom rim of the cover 120 is supported by a bottom of the step portion 111.

If the depth of the step portion 111 is smaller than a thickness of the cover 120, the cover 120 assembled to the main body 110 is projected higher than an upper end of the main body 110. If the depth of the step portion 111 is equal to the thickness of the cover 120, a topside of the cover 120 assembled to the main body 110 coincides with the upper end of the main body 110.

To minimize a height of the food container 100, it is preferable that the thickness of the cover 120 is almost equal to the depth of the step portion 111.

In addition to the above configuration, it is preferable that the food container further comprising at least one packing member between the main body 110 and the cover 120 for securing the airtightness of the food container 100

More particularly, the at least one packing member includes a first packing member 111*a* provided to the step portion 111 of the entrance of the main body 110.

In this case, the first packing member 111*a* is provided to a bottom of the step portion 111 to adhere closely to a bottom of the cover 120. And, the first packing member 111*a* prevents air or particles from passing through a gap between the bottom of the step portion 111 and a bottom rim of the cover 120.

To further enhance the airtightness of the food container 100, it is preferable that the at least one packing member further includes a second packing member 121 contacting with an inside of the packing member 111*a* or an upper inside of the main body 110, wherein the second packing member 121 is downwardly projected from a bottom of the cover.

If the cover 120 is mounted on the entrance of the main body 110 to be locked, the airtightness of the food container 100 can be secured by the first packing member 111*a* and the second packing member 121.

Preferably, the food container 100 further includes at least one handle provided to at least one of the cover 120 and the main body 110.

More particularly, the at least one handle includes at least one cover handle 122 provided at the cover 120.

The at least one cover handle 122 is preferably provided to a topside of the cover 120 to facilitate the cover 120 to be separated from the main body 110 or to facilitate the food container 110 to be carried.

The cover handle 122 may be formed in one body of the cover 120 to be upwardly projected from the topside of the cover 120 or may be assembled to the topside of the cover 120 through locking means such as screws and the like. Preferably, the cover handle 122 is rotatably connected to the topside of the cover 120.

At least one handle accommodating recess 123 is preferably provided to the topside of the cover 120 to accommodate the at least one cover handle 122.

In this case, the cover handle 122 is rotatably connected to the handle accommodating recess 123 by a hinge (not shown in the drawing).

If a user attempts to separate the cover 120 from the main body 110, the cover handle 122 lying in the handle accommodating recess 123 is turned upright to be pulled upward, the cover 120 is separated from the entrance of the main body 110.

After a user puts food in the main body 110 or takes food out of the main body 110, the cover 120 is mounted on the entrance of the main body 110 using the cover handle 122. The cover handle 122 is then laid down to the topside of the cover 120 to be loaded in the handle accommodating recess 123.

While the cover 120 is locked to the main body 110 by a separate locking unit or device 130, the cover handle 122 can be used in lifting or carrying the food container 100.

Of course, to carry the food container 100, the at least one handle includes at least one carrying handle (not shown in the drawing) provided to the main body.

More particularly, at least one carrying handle can be provided to a lateral side of the main body 110. In this case, the carrying handle is preferably provided to each of two lateral sides of the food container or to each upper end of both lateral sides of the food container.

Namely, the cover handle and the carrying handle (not shown in the drawing) are separately provided to the cover 120 and the main body 110, respectively. Alternatively, the cover handle 122 is provided to the cover 120 only. Alternatively, the carrying handle is provided to the main body 110 only. Since the cover handle 122 can be used in carrying the food container 100, the cover handle 122 is preferably provided to the cover 120 only to simplify the configuration of the food container 100.

In the present embodiment, a pair of the cover handles 122 are provided to the topside of the cover 120. A pair of the cover handles 122 are preferably connected to the topside of the cover 120 to be located at the same distances from both edges of both opposing sides of the cover 120, respectively.

Meanwhile, at least one locking device 130 is provided to the main body 110 to prevent the cover 120 from being unlocked.

If the at least one locking device 130 is assembled to an upper part of the cover 120, the cover 120 is locked. If the at least one locking device 130 is released from the upper part of the cover 120, the cover 120 is unlocked to be separated from the main body 110.

In this case, the at least one locking device 130 can be designed in various ways. Preferably, the locking device 130 of the food container 100 according to the present invention is configured to facilitate the cover 120 to be separated from the main body 110 while the food container 100 is accommodated in a prescribed space.

In other words, while the food container 100 is accommodated in such a prescribed space as a storeroom of a refrigerator, if the entrance of the main body 110 is easily opened, a user can easily keep the food within the food container 100 or can easily take out the food from the food container 100.

For this, preferably, one side of the locking device 130 is connected to the main body 110 and the other side of the locking device 130 is detachably engaged with the upper part of the cover 120.

An engaging member 124 is provided to the topside of the cover 120 to be selective engaged with the locking device 130. In particular, the locking device 130 is detachably locked to the engaging member 124 to prevent the cover 120 from being separated from the main body 110.

The engaging member 124 is the element that catches the locking device 130 to be selective engaged with. And, the engaging member 124 can have such a various shape as a hook, a recess, a ring and the like.

In the present embodiment, the engaging member 124 has a projected type upwardly projected in one body from the topside of the cover 120 for example.

The locking device 130 includes an engaging hole 131 into which the engaging member 124 is fitted. In this case, the number of the engaging holes 131 is equal to that of the engaging members 124. In the present invention, a pair of the engaging members 124 are selectively engaged with the corresponding locking device 130 for example.

In addition to the above configuration, the engaging member 124 includes a catching protrusion **124*a* preventing the locking device 130 from being separated from the engaging member 124**.

Of course, if the engaging member 124 is fitted into the engaging hole 131 of the locking device 130, the engagement between the locking device 130 and the engaging member 124 can be sustained by a prescribed frictional force.

To make sure that the locking device 130 can be prevented from being separated from the engaging member 124, the catching protrusion **124*a* protrudes from a lateral side of the engaging member 124. And, the locking device 130 is caught by the catching protrusion 124*a***.

In this case, the catching protrusion **124*a* includes a catching sill protruding from a topside of the engaging member 124 in a lateral direction to catch the locking member 130**.

Preferably, the above-configured locking device 130 is rotatably connected to the upper end of the main body 110.

In this case, the locking device 130 can be connected to the upper end of the main body 110 by a hinge or the like. Preferably, the locking device 130 is formed in one body at the upper end of the main body 110.

The locking device 130 may include a one-body type locking member 132 having the engaging hole 131 located at a position opposing the engaging member 124.

Preferably, the locking member 132 is substantially configured to have a lever type having a '1' shape. One end of the locking member 132 is rotatably connected to the upper end of the main body 110. More preferably, one end of the locking member 132 is connected to an edge of the upper end of the main body 110.

One end of the locking member 132 applied to the food container according to one embodiment of the present invention is rotatably connected to the rim of the upper end of the main body 110.

Although not shown in the drawings, the locking member 132 can be provided to the lateral side of the main body 110. In this case, the locking member 132 can be rotatably connected to the main body 110. If the locking member 132 is not rotatable, the locking member 132 is preferably formed of a flexible material.

Preferably, the food container further includes an unlocking part 133 handled over the cover to separate the locking device 130 from the cover 120, i.e., the engaging member 124 of the cover.

In this case, the unlocking part 133 can be formed in various ways. In the present embodiment, the unlocking part 133 is configured by bending the other side of the locking unit device 130 so that a gap can be generated between the upper part of the cover 120, i.e., the topside of the cover 120 and the unlocking part 133 while the locking device 130 is engaged with the engaging member 124.

In particular, the unlocking part 133 is built in one body of the other side of the locking member 132.

In this case, the gap generated between the topside of the cover 120 and the unlocking part 133 has a size enough for a user's finger to enter In the above-configured locking device 130, while the food container 100 is accommodated in such a prescribed space as a storeroom of a refrigerator, the cover 120 can be separated from the main body 100 in an upper direction without interference with the locking device 130 in being opened.

In addition to the above configuration, it is preferable that the food container 100 further includes at least one pressing member 134 that presses the topside of the cover 120.

This to secure the airtightness of the food container 100 according to the present invention reliably.

The pressing member 134 is downwardly protruding from the locking device 130, and more particularly, from the bottom of the locking member 132 to pressurize the topside of the cover 120 while engaged with the engaging member 124.

Preferably, the pressing member 134 is formed of an elastic material member downwardly protruding in one body from a lower side of the locking member 132.

Meanwhile, the locking device 130 is preferably formed of a material returning to a position having an angle θ of at least 90°, and more preferably, 90°~135° against the cover due to its elasticity after having been separated from the cover 120.

For this, the body 110 and the locking member 132 are built in one body by injection molding. Hence, while the locking device 130, and more particularly, the locking member 132 is engaged with the engaging member 124, a tensile stress can work within an elastic range of the topside of the locking member 132 or an outer side of one end as a rotational center of the locking member 132.

If a user just conducts an action of separating the locking device 130 from the engaging member 124, the locking device 130 returns to the position having the angle θ of at least 90° against the topside of the cover 120. Hence, the cover 120 avoids being caught by the locking device 130 in being opened.

Of course, if the locking member 132 is rotatably connected to the main body 110 by a hinge or the like, the main body 110 and the locking member 132 are connected via a separate elastic member such as a spring and the like to enable the locking member 132 to return to its original position.

The above-configured locking device 130 is provided to one side of the upper end of the main body 110. And, the above-configured locking device 130 is also provided to the other side of the upper end of the main body 110 to oppose the other locking device 130. And, the engaging members 124 are provided to the topside of the cover 120 to correspond to the locking devices 130, respectively.

In case that the above-configured food container has a rectangular box shape, at least one locking device 130 can be provided to each of four edges of the upper end of the main body.

A refrigerator having the above-configured food container according to another embodiment of the present invention is explained with reference to FIGS. 3 to 6 as follows.

Figure 3:
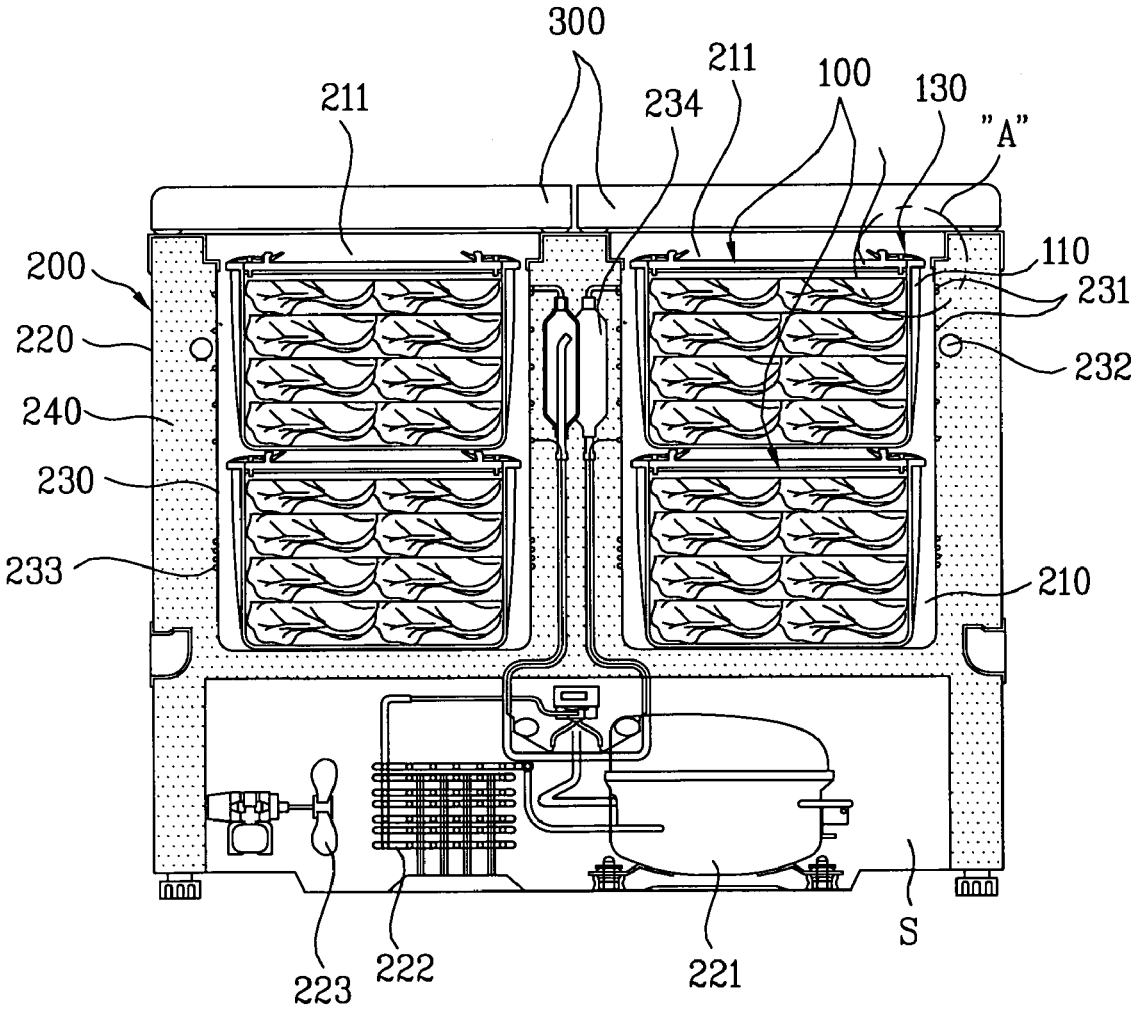
FIG. 3 is a cross-sectional diagram of a refrigerator having the food container shown in FIG. 1 according to one embodiment of the present invention.
Figure 4:
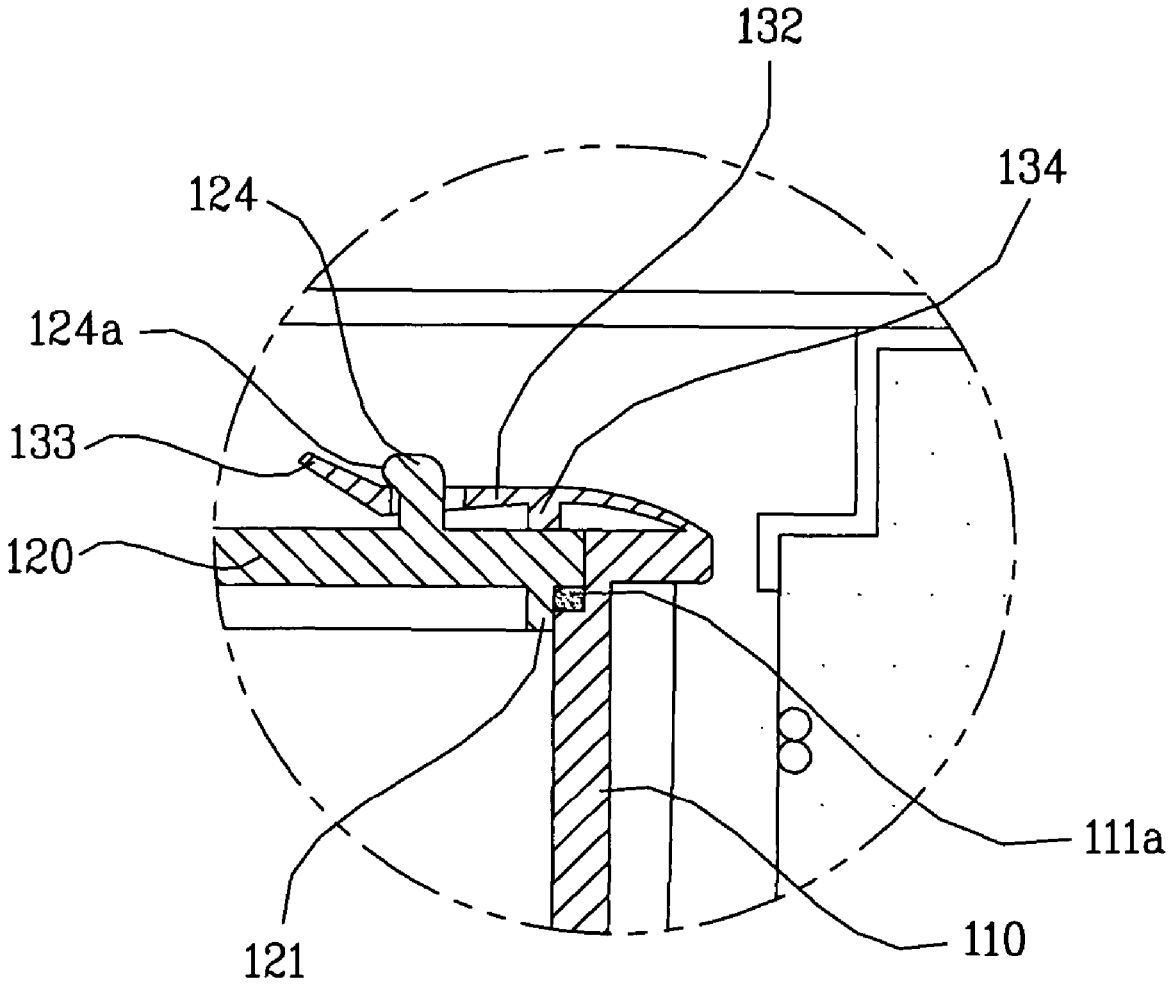
FIG. 4 is an enlarged cross-sectional diagram of a part 'A' shown in FIG. 3.
Figure 5:
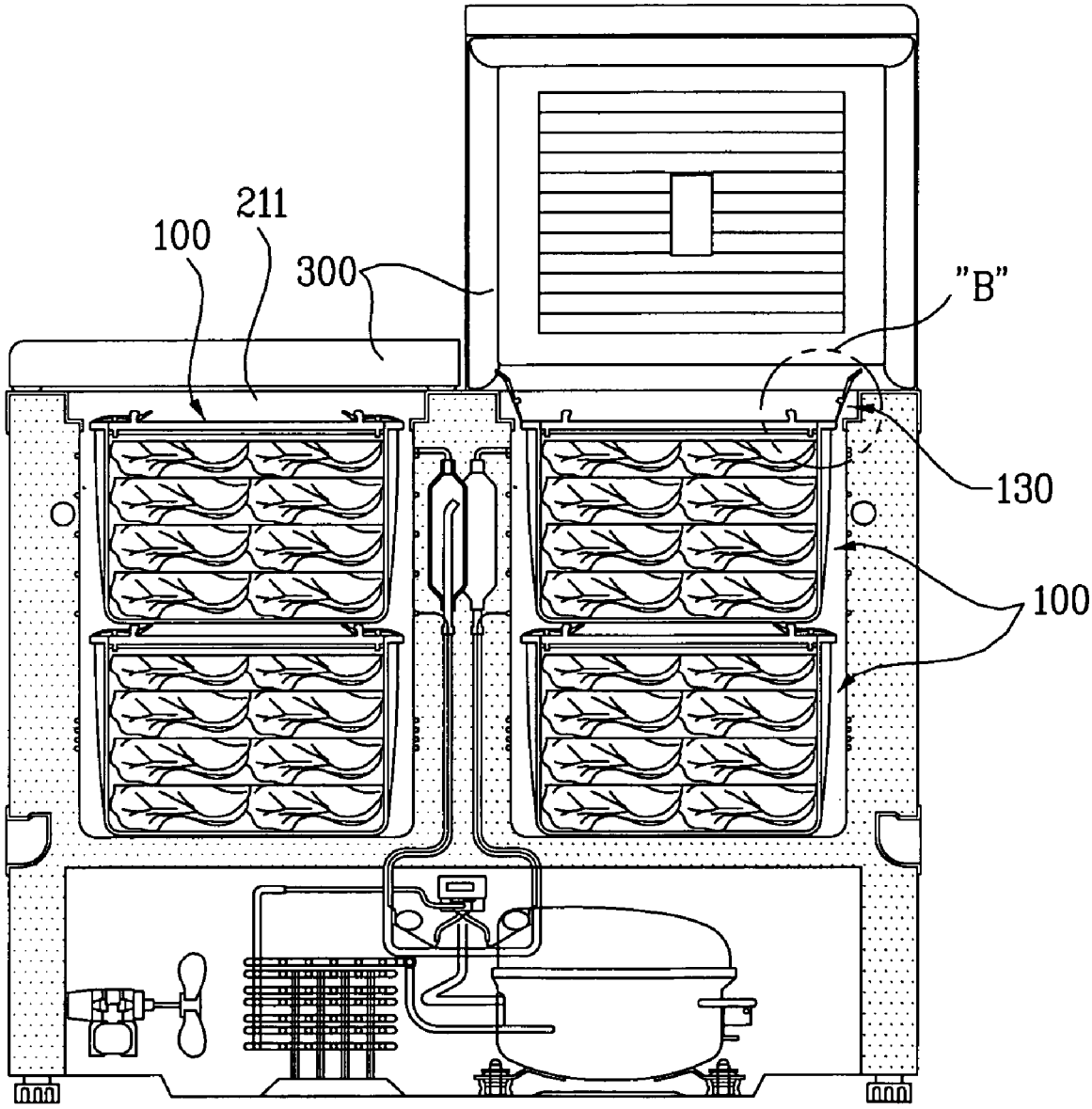
FIG. 5 is a cross-sectional diagram of a refrigerator having a food container according to one embodiment of the present invention, in which a cover of the food container is unlocked to open the cover.
Figure 6:
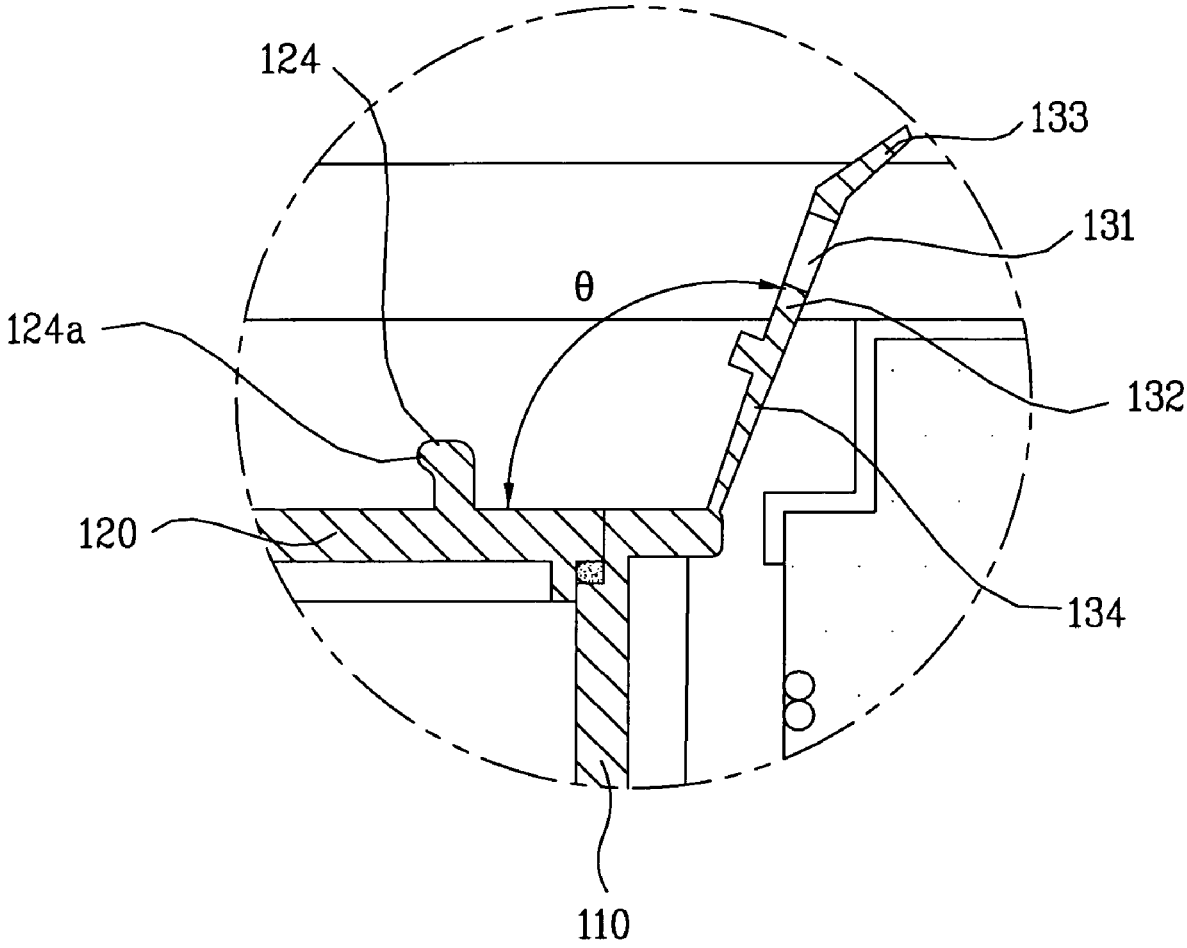
FIG. 6 is an enlarged cross-sectional diagram of a part 'B' shown in FIG. 5.

FIG. 3 is a cross-sectional diagram of a refrigerator having the food container shown in FIG. 1 according to one embodiment of the present invention, FIG. 4 is an enlarged cross-sectional diagram of a part 'A' shown in FIG. 3, FIG. 5 is a cross-sectional diagram of a refrigerator having a food container according to one embodiment of the present invention, in which a cover of the food container is unlocked to open the cover, and FIG. 6 is an enlarged cross-sectional diagram of a part 'B' shown in FIG. 5.

A refrigerator can store food or beverage to keep fresh by a cooling cycle.

In particular, a refrigerant circulating along a prescribed path sequentially passes through a compressor, a condenser, an expander and an evaporator to undergo phase changes. By the phase changes, a temperature of an inside of the refrigerator can be maintained low.

Referring to FIG. 3, a refrigerator according to one embodiment of the present invention includes the aforesaid food container 100 and a cabinet 200 having at least one storeroom 210 accommodating the food container 100.

The cabinet 200 includes an outer case 220 formed an exterior of the refrigerator, an inner case forming the storeroom 210, and a heat insulator 240 provided between the outer case 220 and the inner case 230.

In this case, various kinds of food such as fruits, vegetables and the like can be kept in the storeroom 210 of the cabinet 200.

The cabinet 200 is opened/closed by at least one door 300, and more preferably, a pair of doors 300. And, the inner case 230 configures at least a pair of the storerooms 210.

In this case, an entrance 211 of the storeroom 210 is provided to an upper part of the storeroom 210. And, the door 300 is provided to a topside of the cabinet 200 to open/close the entrance 211 of the storeroom 211.

Hence, the food container 100 is vertically put in or pulled out of the storeroom 210.

Various devices configuring a cooling system are provided to the cabinet 200. In particular, a compressor 221, a condenser 222, a fan 223 and the like are provided to a lower space S of the cabinet 200, whereas an evaporator 231 is provided to an upper circumference of the inner case 230.

An accumulator 234 is provided between a pair of the storerooms 210, and a pair of temperature sensors 232 are provided to two opposing sides of the inner case 230 to sense temperatures of the storerooms, respectively.

Meanwhile, the refrigerator according to the present invention is preferably configured to perform a function of ripening the food kept within the storeroom. In particular, the refrigerator according to the present invention can carry out a function of ripening such food as 'Kimchi' (Korean fermented food) to a suitable state.

For this, a heating device is provided within the cabinet 200. The heating device includes a fermentation heater 233 provided to a lower circumference of the inner case 230 to ferment the food such as 'Kimchi' stored in the storeroom 210.

Hence, in case that the food container accommodating the food needing fermentation such as 'Kimchi' is stored in the storeroom 210, the food such as Kimchi can be quickly fermented suitable for user's taste using the fermentation heater 233.

After completion of the fermentation, the temperature of the inside of the storeroom can be appropriately maintained to enable a long-term storage with uniform flavor and freshness of the food such as 'Kimchi' and the like.

A process of opening/closing the food container 100 kept within the storeroom 210 of the refrigerator according to the present invention is explained as follows.

Referring to FIG. 3 and FIG. 4, the cover 120 is mounted on the entrance of the main body 110 to close the entrance of the main body 110. The locking device 130 is then pressed toward the topside of the cover 120. If so, the engaging hole 131 of the locking device 130 is caught by the catching protrusion 124*a* of the engaging member.

Hence, the main body 110 of the food container 100 is sealed by the cover 120.

Referring to FIG. 5 and FIG. 6, in case that a user attempts to take out the food from the food container 100, the unlocking part 133 of the locking device is pulled upward so that the locking unit 130 can be separated from the engaging member 124.

In particular, since the locking device 130 is separated from the engaging member 124 of the cover 120 by manipulating the unlocking part 133 provided over the cover 120, a user is facilitated to unlock the cover 120 without being interrupted by a wall of the storeroom 210 while the food container 100 is accommodated in such a prescribed space as the storeroom 210 of the refrigerator.

The locking device 130 is turned by its elasticity or user's manipulation to be widened outwardly not to interrupt the separation of the cover 120.

Subsequently, the user upwardly pulls the cover handle 122 provided to the topside of the cover 120 to separate the cover 120 from the main body 110.

In case that the user attempts to separate the cover 120 from the main body 110 while the food container 100 is accommodated in such a prescribed space as the storeroom 210 of the refrigerator, the entrance of the main body 100 can be easily opened as the cover 120 can avoid the interruption of the locking device 130.

This is because a space enabling the cover 120 to be separable is secured while the locking device 130 is contacting with an inner wall of the storeroom 210 after the separation from the cover 120.

Hence, while the food container 100 is accommodated in the prescribed space such as the storeroom 210 of the refrigerator, the user can easily store the food in the food container 100 and can easily take out the food from the food container 100.

Accordingly, the present invention provides the following effects or advantages.

First of all, the food container of the present invention, which is being accommodated in such a prescribed space as the storeroom of the refrigerator, is easily opened or closed, thereby facilitating the food to be stored or taken out.

Secondly, by the food container according to the present invention, since the locking unit locking the cover of the food container automatically returns to the position avoiding interruption with the cover in opening the cover, the cover can be easily opened.

Thirdly, by the food container according to the present invention, since the food container needs not to be taken out of the storeroom to store or take out the food, a safety accident is prevented from occurring in the process of putting/drawing the food container in/from the storeroom.

Fourthly, by the food container according to the present invention, since the locking unit is built in one body of the food container, the fabrication of the food container is facilitated.

Fifthly, by the food container according to the present invention, since the pressing member is provided to the locking unit, as the pressing member presses the topside of the cover while the locking unit is engaged with the engaging member of the cover, the airtightness of the food container is enhanced.

Finally, by the food container according to the present invention, since the cover handle is provided to the topside of the cover, the present invention facilitates the food container to be carried or facilitates the cover to be separated.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A food container for a refrigerator, comprising:

a main body comprising an entrance on a top side of the main body;

a cover that opens or closes the entrance of the main body, wherein the cover comprises at least one engaging member that protrudes upwardly from the top side of the cover; and at least one locking device having one side connected to the main body and another side detachably engaged with an upper part of the cover to prevent the cover from being opened, wherein the at least one locking device comprises at least one engaging hole into which the at least one engaging member is inserted, and wherein the at least one locking device returns to a position at an angle of at least 90° from the top side of the cover due to elasticity of the at least one locking device after having been separated from the cover.

2. The food container of claim 1, wherein the at least one engaging member is formed as one body with the cover, and wherein a catching protrusion is provided on a lateral side of the at least one engaging member configured to catch the at least one locking device.

3. The food container of claim 1, further comprising at least one unlocking part configured to be manipulated over the cover to separate the at least one locking device from the cover.

4. The food container of claim 3, wherein the at least one unlocking part is formed by bending the another side of the at least one locking device upwardly to form a gap between the top side of the cover and the at least one unlocking part while the at least one locking device is engaged with the upper part of the cover.

5. The food container of claim 1, further comprising at least one pressing member that downwardly protrudes from the at least one locking device to press the top side of the cover while the at least one locking device is engaged with the at least one engaging member.

6. The food container of claim 1, wherein the at least one locking device is rotatably connected to an upper end of the main body.

7. The food container of claim 1, further comprising at least one packing member between the main body and the cover configured to secure an airtightness of the food container.

8. The food container of claim 1, further comprising at least one handle provided on at least one of the cover or the main body.

9. The food container of claim 8, wherein the at least one handle comprises at least one cover handle rotatably connected to the top side of the cover and wherein the cover further comprises at least one handle accommodating recess provided on the top side of the cover to accommodate the at least one cover handle therein.

10. A refrigerator, comprising:

a cabinet comprising at least one storeroom that stores food; and at least one food container accommodated in the at least one storeroom and configured to be vertically put into or pulled out from the at least one storeroom, the at least one food container comprising:

a main body comprising an entrance on a top side of the main body;

a cover that opens or closes the entrance of the main body; and at least one locking device having one side connected to the main body and another side detachably engaged with an upper part of the cover to prevent the cover from being opened, wherein the cover comprises at least one engaging member that protrudes upwardly from the top side of the cover, wherein the at least one engaging member comprises at least one catching protrusion provided on a lateral side thereof configured to catch the at least one locking device, and wherein the at least one locking device returns to a position at an angle of at least 90° from the cover due to elasticity of the at least one locking device after having been separated from the cover.

11. The refrigerator of claim 10, wherein the at least one locking device further comprises an unlocking part that separates the at least one locking device from the at least one engaging member to open the cover, and wherein the unlocking part is formed by bending the another side of the at least one locking device upwardly to form a gap between the top side of the cover and the unlocking part while the at least one locking device is engaged with the upper part of the cover.

12. The refrigerator of claim 10, further comprising at least one pressing member that protrudes downwardly from the at least one locking device to press the top side of the cover while the at least one locking device is engaged with the at least one engaging member.

13. The refrigerator of claim 10, wherein the at least one locking device is rotatably connected to a rim of an upper end of the main body.

14. The refrigerator of claim 10, further comprising:

at least one cover handle rotatably connected to the top side of the cover; and at least one handle accommodating recess provided in the top side of the cover to accommodate the at least one cover handle therein.

15. A food container, comprising:

a main body comprising an entrance on a top side of the main body;

a cover that opens or closes the entrance of the main body; and at least one locking device having one side connected to the main body and another side detachably engaged with an upper part of the cover to prevent the cover from being opened, wherein the at least one locking device comprises an unlocking part configured to be manipulated over the cover to separate the at least one locking device from the cover, wherein the at least one unlocking part is formed by bending the another side of the at least one locking device upwardly to form a gap between the top side of the cover and the unlocking part while the at least one locking device is engaged with the upper part of the cover, and wherein the at least one locking device returns to a position at an angle of at least 90° from the cover due to elasticity of the at least one locking device after having been separated from the cover.

16. A food container, comprising:

a main body comprising an entrance on a top side of the main body;

a cover that opens or closes the entrance of the main body; and at least one locking device having one side connected to the main body and another side detachably engaged with an upper part of the cover to prevent the cover from being opened, wherein the at least one locking device returns to a position at an angle of at least substantially 90° from the cover due to elasticity of the at least one locking device after having been separated from the cover.

17. A food container, comprising:

a main body comprising an entrance on a top side of the main body;

a cover that opens or closes the entrance of the main body;

at least one locking device having one side connected to the main body and another side detachably engaged with an upper part of the cover to prevent the cover from being opened; and at least one cover handle rotatably connected to the top side of the cover, wherein the cover comprises at least one handle accommodating recess provided on the top side of the cover to accommodate the at least one cover handle therein.

18. A refrigerator, comprising:

a cabinet comprising at least one storeroom that stores food; and at least one food container accommodated in the at least one storeroom and configured to be vertically put into or pulled out from the at least one storeroom, the at least one food container comprising:

a main body comprising an entrance on a top side of the main body;

a cover that opens or closes the entrance of the main body, wherein the cover comprises at least one engaging member that protrudes upwardly from the top side of the cover; and at least one locking device having one side connected to the main body and another side detachably engaged with an upper part of the cover to prevent the cover from being opened, wherein the at least one locking device comprises an unlocking part that separates the at least one locking device from the at least one engaging member to open the cover, and wherein the at least one unlocking part is formed by bending the another side of the at least one locking device upwardly to form a gap between the top side of the cover and the unlocking part while the at least one locking device is engaged with the upper part of the cover, and wherein the at least one locking device returns to a position at an angle of at least 90° from the upper part of the cover due to elasticity of the at least one locking device after having been separated from the cover.

19. A refrigerator, comprising:

a cabinet comprising at least one storeroom that stores food; and at least one food container accommodated in the at least one storeroom and configured to be vertically put into or pulled out from the at least one storeroom, the at least one food container comprising:

a main body comprising an entrance on a top side of the main body;

a cover that opens or closes the entrance of the main body; and at least one locking device having one side connected to the main body and another side detachably engaged with an upper part of the cover to prevent the cover from being opened, wherein the at least one locking device returns to a position at an angle of at least 90° from the upper part of the cover due to elasticity of the at least one locking device after having been separated from the cover.

20. A refrigerator, comprising:

a cabinet comprising at least one storeroom that stores food; and at least one food container accommodated in the at least one storeroom configured to be vertically put into or pulled out from the at least one storeroom, the at least one food container comprising:

a main body comprising an entrance on a top side of the main body;

a cover that opens or closes the entrance of the main body;

at least one cover handle rotatably connected to the top side of the cover;

at least one handle accommodating recess provided in the top side of the cover to accommodate the at least one cover handle therein; and at least one locking device having one side connected to the main body and another side detachably engaged with an upper part of the cover to prevent the cover from being opened.

21. The food container of claim 16, wherein the locking device automatically returns to said position that corresponds to an angle of at least substantially 90° from the cover based on forces from a spring coupled to the locking device.

* * * * *